US009886045B2

(12) United States Patent
Endo

(10) Patent No.: US 9,886,045 B2
(45) Date of Patent: Feb. 6, 2018

(54) VOLTAGE REGULATOR EQUIPPED WITH AN OVERCURRENT PROTECTION CIRCUIT CAPABLE OF ADJUSTING A LIMITED CURRENT AND A SHORT-CIRCUITED CURRENT

(71) Applicant: SII Semiconductor Corporation, Chiba-shi, Chiba (JP)

(72) Inventor: Daiki Endo, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 15/225,924

(22) Filed: Aug. 2, 2016

(65) Prior Publication Data

US 2017/0047836 A1 Feb. 16, 2017

(30) Foreign Application Priority Data

Aug. 10, 2015 (JP) ..... 2015-158562

(51) Int. Cl.
*G05F 1/56* (2006.01)
*G05F 1/575* (2006.01)

(52) U.S. Cl.
CPC ..... *G05F 1/56* (2013.01); *G05F 1/575* (2013.01)

(58) Field of Classification Search
CPC ..... G05F 1/56; G05F 1/573–1/575; G05F 1/5735; G05F 3/30; G05F 3/262; G05F 3/265; Y02B 70/1466; H02M 3/156–3/158; H02M 3/1588; H02M 1/08; H02M 1/32; H02M 3/06
USPC ..... 323/274, 275, 282, 284, 312, 315, 316; 361/18, 93.1, 93.3, 93.5, 103
See application file for complete search history.

(56) References Cited

U.S. PATENT DOCUMENTS 6,801,419 B2 * 10/2004 Fukui ..... G05F 1/573 361/93.1
7,183,755 B2 * 2/2007 Itoh ..... G05F 1/5735 323/274
7,215,191 B2 * 5/2007 Maejima ..... H03G 3/3026 330/10
7,315,154 B2 * 1/2008 Sugiura ..... G05F 1/565 323/276
7,646,188 B2 * 1/2010 Suzuki ..... G05F 1/56 323/222

(Continued)

FOREIGN PATENT DOCUMENTS

JP 02-189608 7/1990

*Primary Examiner* — Yemane Mehari
(74) *Attorney, Agent, or Firm* — Brinks Gilson & Lione

(57) ABSTRACT

To provide a voltage regulator equipped with an overcurrent protection circuit which needs not to separately adjust a limited current and a short-circuited current and is capable of collectively adjusting them. There is provided an overcurrent protection circuit equipped with an output current limitation circuit which distributes a current supplied from a transistor sensing an output current of an output transistor and controls a gate voltage of the output transistor by the distributed current to limit the output current. The overcurrent protection circuit is configured in such a manner that the current distributed from the transistor sensing the output current is varied according to the voltage outputted from the output transistor, and its distribution ratio is determined by a size ratio between elements.

6 Claims, 4 Drawing Sheets

(56) References Cited

U.S. PATENT DOCUMENTS

| | | | | |
|---|---|---|---|---|
| 7,692,481 | B2 * | 4/2010 | Roh | G05F 3/30 323/312 |
| 8,680,828 | B2 * | 3/2014 | Heng | G05F 1/575 323/275 |
| 2002/0135424 | A1 * | 9/2002 | Oikawa | G05F 3/262 330/288 |
| 2007/0247215 | A1 * | 10/2007 | Chen | G05F 3/262 327/543 |
| 2008/0164913 | A1 * | 7/2008 | Hirata | H03F 3/45 327/58 |
| 2008/0265852 | A1 * | 10/2008 | Imura | G05F 1/575 323/277 |

* cited by examiner

VOLTAGE REGULATOR EQUIPPED WITH AN OVERCURRENT PROTECTION CIRCUIT CAPABLE OF ADJUSTING A LIMITED CURRENT AND A SHORT-CIRCUITED CURRENT

RELATED APPLICATIONS

This application claims priority under 35 U.S.C. §119 to Japanese Patent Application No. 2015-158562 filed on Aug. 10, 2015, the entire content of which is hereby incorporated by reference.

BACKGROUND OF THE INVENTION

Field of the Invention

The present invention relates to a voltage regulator, and particularly to a voltage regulator equipped with an overcurrent protection circuit.

Background Art

As an overcurrent protection circuit of a voltage regulator, there are known an overcurrent protection circuit (drooping type overcurrent protection circuit) in which an output current-voltage characteristic becomes a drooping characteristic, and an overcurrent protection circuit (fold-back type overcurrent protection circuit) in which an output current-voltage characteristic becomes a fold-back characteristic.

The drooping type overcurrent protection circuit limits a current flowing through an output transistor of a voltage regulator so as not to exceed a predetermined current as illustrated in, for example, Patent Document 1. Since the limited current (hereinafter also called a "limited current") which flows through the output transistor varies due to a manufacturing process, a resistor which receives a current made to flow by a sense transistor sensing an output current, is comprised of a plurality of resistive elements. This resistor is trimmed to thereby adjust its resistance value and set the limited current to a desired value.

On the other hand, the fold-back type overcurrent protection circuit is a circuit for preventing breakage of an IC due to an excessive loss generated when an output terminal of a voltage regulator is short-circuited to a ground terminal. As illustrated in Patent Document 2, for example, when a current of a certain value or more flows through an output transistor of the voltage regulator, current limiting is started to positively reduce an output current with lowering of an output voltage of the output transistor. Incidentally, the current flowing through the output transistor when the output terminal is short-circuited to the ground terminal is referred to as a "short-circuited current". Even in the fold-back type overcurrent protection circuit as with the above-described drooping type overcurrent protection circuit, a resistor which receives a current made to flow by a sense transistor is comprised of a plurality of resistive elements. This resistor is trimmed to thereby adjust its resistance value and set the short-circuited current to a desired value.

[Patent Document 1] Japanese Patent Application Laid-Open No. 2003-29856

[Patent Document 2] Japanese Patent Publication No. Hei 7 (1995)-74976

SUMMARY OF THE INVENTION

In order to obtain both of the drooping characteristic and the fold-back characteristic by the overcurrent protection circuits in the related art voltage regulator, there arises a need to allow such a drooping type overcurrent protection circuit as described in Patent Document 1 and such a fold-back type overcurrent protection circuit as described in Patent Document 2 to exist together. As described above, however, the related art drooping type overcurrent protection circuit and fold-back type overcurrent protection circuit are respectively accompanied by a problem that in order to set the limited current and the short-circuited current to the desired value with respect to the variations in the manufacturing process, there arises a need to configure each of the adjustment resistors in both protection circuits by the plural resistive elements, thereby increasing a chip size.

Thus, an object of the present invention is to solve the above-described problems and provide a voltage regulator equipped with an overcurrent protection circuit which needs not to separately adjust a limited current and a short-circuited current and is capable of collectively adjusting both currents.

In order to solve the above-described problems, there is provided a voltage regulator according to the present invention, which is equipped with an output transistor, a first error amplifier circuit which amplifies and outputs a difference between a divided voltage obtained by dividing a voltage outputted from the output transistor and a reference voltage and thereby controls a gate of the output transistor, and an overcurrent protection circuit which detects that an overcurrent flows through the output transistor, to thereby limit the overcurrent of the output transistor. The overcurrent protection circuit includes a first transistor which is controlled by an output voltage of the first error amplifier circuit and senses an output current of the output transistor, a second transistor having a source grounded, and a gate and a drain connected to a drain of the first transistor, a third transistor having a drain connected to the drain of the first transistor, a first resistor connected to a source of the third transistor, a fourth transistor having a source grounded, a gate connected to the gate and drain of the second transistor, and a drain connected to the source of the third transistor through the first resistor, a fifth transistor having a source grounded, and a gate connected to the gate and drain of the second transistor, a voltage control voltage source which controls a gate of the third transistor in such a manner that the voltage outputted from the output transistor and a voltage applied across the first resistor become equal to each other, and a current mirror circuit which outputs a current proportional to a current flowing through the fifth transistor. The overcurrent protection circuit is equipped with an output current limitation circuit which controls a gate voltage of the output transistor by the current outputted from the current mirror circuit.

According to the voltage regulator equipped with the overcurrent protection circuit of the present invention, it is possible to determine the ratio between a limited current and a short-circuited current according to the ratio in size between the second transistor and the fourth transistor. Variations in the limited current and the short-circuited current due to variations in a manufacturing process can be adjusted only by trimming one resistor, i.e., collectively. It is thus possible to suppress an increase in chip size.

DETAILED DESCRIPTION OF THE PREFERRED EMBODIMENTS

Preferred embodiments of the present invention will hereinafter be described with reference to the accompanying drawings.

[First Embodiment]

Figure 1:
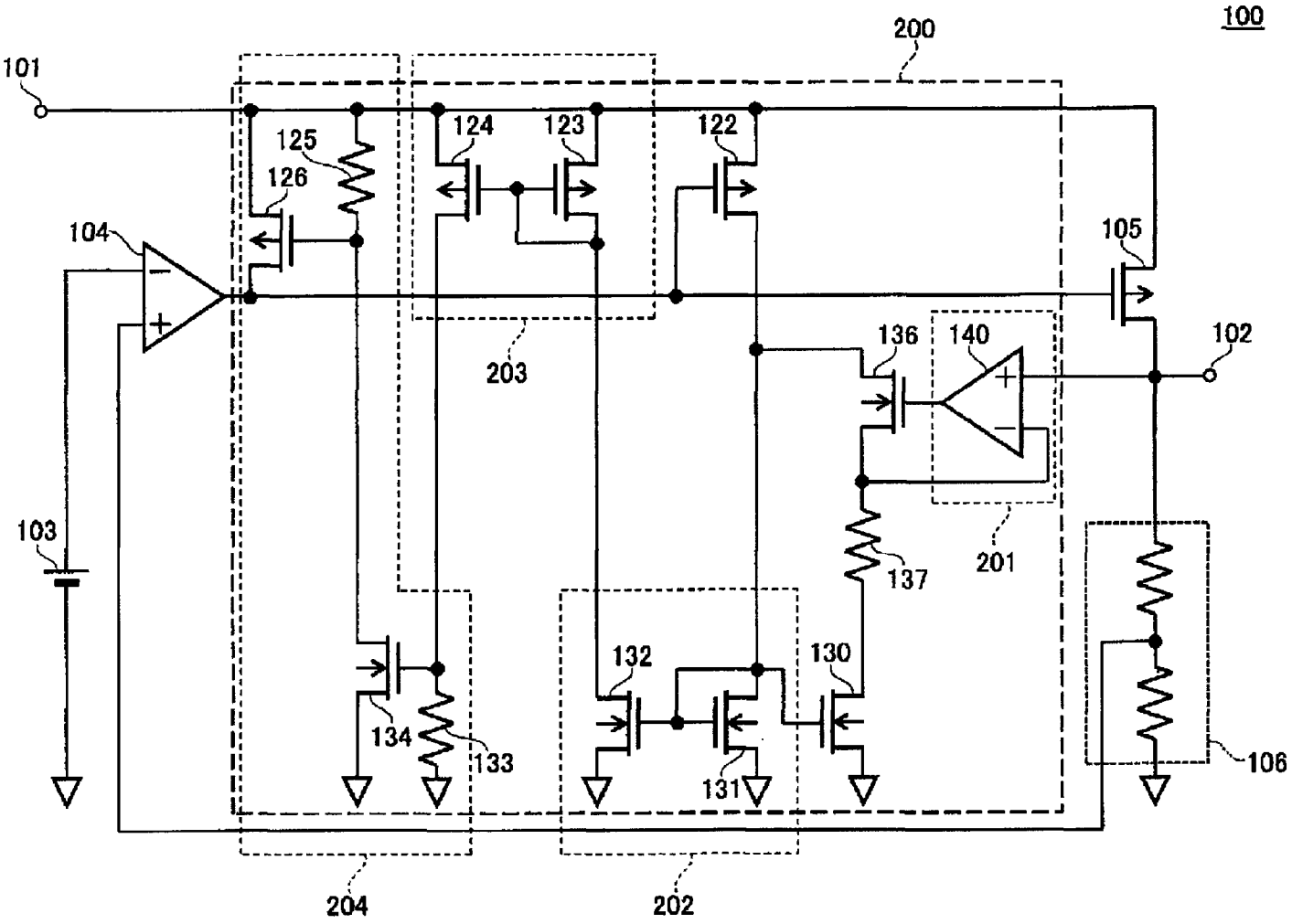
FIG. 1 is a circuit diagram of a voltage regulator equipped with an overcurrent protection circuit, according to a first embodiment of the present invention.

FIG. 1 is a circuit diagram of a voltage regulator equipped with an overcurrent protection circuit, according to a first embodiment of the present invention.

The voltage regulator according to the first embodiment has a power supply terminal 101, an output terminal 102, a reference voltage circuit 103, an error amplifier (error amplifier circuit) 104, a PMOS transistor (output transistor) 105, a voltage division circuit 106, and an overcurrent protection circuit 200.

The output transistor 105 has a gate connected to an output terminal of the error amplifier 104, a source connected to the power supply terminal 101, and a drain connected to the output terminal 102. The output terminal 102 is connected to the voltage division circuit 106. An output terminal of the voltage division circuit 106 is connected to a non-inversion input terminal of the error amplifier 104. An output terminal of the reference voltage circuit 103 is connected to an inversion input terminal of the error amplifier 104.

Thus, the error amplifier 104 compares an output terminal voltage of the voltage division circuit 106 and a voltage of the reference voltage circuit 103 and drives the output transistor 105 in such a manner that the output terminal voltage of the voltage division circuit 106 becomes equal to the voltage of the reference voltage circuit 103, thereby controlling the output terminal 102 to a constant voltage.

The overcurrent protection circuit 200 will next be described.

The overcurrent protection circuit 200 is equipped with PMOS transistors 122, 123, 124, and 126, NMOS transistors 130, 131, 132, 134, and 136, resistors 125, 133, and 137, and an error amplifier 140.

The PMOS transistor 122 has a gate connected to the output terminal of the error amplifier 104, and a source connected to the power supply terminal 101. A gate and a drain of the NMOS transistor 131 are connected to a drain of the PMOS transistor 122, and a source thereof is connected to a ground terminal. A gate of the NMOS transistor 132 is connected to the gate and drain of the NMOS transistor 131, and a source thereof is connected to the ground terminal. A gate and a drain of the PMOS transistor 123 are connected to a drain of the NMOS transistor 132, and a source thereof is connected to the power supply terminal 101. A gate of the PMOS transistor 124 is connected to the gate and drain of the PMOS transistor 123, and a source thereof is connected to the power supply terminal 101. The resistor 133 has one end connected to a drain of the PMOS transistor 124, and the other terminal connected to the ground terminal. A gate of the NMOS transistor 134 is connected to one end of the resistor 133 and the drain of the PMOS transistor 124, and a source thereof is connected to the ground terminal. The resistor 125 has one end connected to a drain of the NMOS transistor 134, and the other end connected to the power supply terminal 101. The PMOS transistor 126 has a gate connected to one end of the resistor 125 and the drain of the NMOS transistor 134, a source connected to the power supply terminal 101, and a drain connected to the output terminal of the error amplifier 104. The NMOS transistor 136 has a drain connected to the drain of the PMOS transistor 122, a gate connected to the output terminal of the error amplifier 140, and a source connected to one end of the resistor 137. The error amplifier 140 has a non-inversion input terminal connected to the output terminal 102, and an inversion input terminal connected to the source of the NMOS transistor 136 and one end of the resistor 137. The resistor 137 has the other end connected to a drain of the NMOS transistor 130. The NMOS transistor 130 has a gate connected to the gate and drain of the NMOS transistor 131, and a source connected to the ground terminal.

Incidentally, a voltage control voltage source 201 is configured by the error amplifier 140. A current mirror circuit 202 is configured by the NMOS transistors 131 and 132. A current mirror circuit 203 is configured by the PMOS transistors 123 and 124. An output current limitation circuit 204 is configured by the resistor 125, the PMOS transistor 126, the resistor 133, and the NMOS transistor 134.

The operation of the overcurrent protection circuit 200 will next be described. Since the PMOS transistor 122 is made common to the output transistor 105 in terms of the gate and source, the PMOS transistor 122 allows a current proportional to a current supplied to a load by the output transistor 105 to flow from its drain. The current which flows from the drain of the PMOS transistor 122 is distributed to the NMOS transistor 131 and the NMOS transistor 136 which are connected in parallel.

The error amplifier 140 compares the voltage of the output terminal 102 and the voltage developed across the resistor 137 and controls a gate voltage of the NMOS transistor 136 in such a manner that the voltage of the output terminal 102 and a source voltage of the NMOS transistor 136 become equal to each other.

Now consider where the voltage of the output terminal 102 is high in a state in which an overcurrent flows to the output terminal 102. Since the voltage of the output terminal 102 is high, the NMOS transistor 136 is controlled in gate voltage in such a manner the source voltage thereof is made high by carrying a current thereto. Since the resistor 137 and the NMOS transistor 130 are connected in series, the current flowing through the resistor 137 is determined by a current mirror circuit comprised of the NMOS transistors 130 and 131. Assuming that a transistor size ratio between the NMOS transistors 130 and 131 is n:1, the current flowing from the drain of the PMOS transistor 122 is distributed to the NMOS transistors 130 and 131 in the form of n:1. That is, an output current-voltage characteristic indicates a drooping characteristic.

Next consider where the voltage of the output terminal 102 is lowered due to the overcurrent flowing through the output terminal 102. The NMOS transistor 136 is controlled in gate voltage such that the source voltage thereof becomes low. The current flowing through the NMOS transistor 130 is limited by the voltage (voltage of output terminal 102) applied across the resistor 137 and the resistance value of the resistor 137 according to the reduction in the voltage of the output terminal 102. Assuming that the current flowing through the NMOS transistor 130 when the output terminal 102 is short-circuited to the ground terminal is so sufficiently small as to be ignorable as compared with the current flowing through the NMOS transistor 131, the distribution ratio of the current flowing from the PMOS transistor 122 to the NMOS transistor 131 is increased to an n+1. Since a decrease in the current flowing through the NMOS transistor 130 is a change due to the lowering of the resistance value of the resistor 137 and the voltage applied across the resistor 137, which is equal to the voltage of the output terminal 102, it results in a linear change with respect to the voltage of the output terminal 102. That is, the output current-voltage characteristic indicates a fold-back characteristic.

By the current mirror circuit 202 and the current mirror circuit 203, the current flowing through the NMOS transistor 131 is applied to the resistor 133 as a current proportional to the current flowing through the PMOS transistor 122. A voltage developed across the resistor 133 is amplified by a source ground amplifier circuit comprised of the resistor 125 and the NMOS transistor 134 and drives the PMOS transistor 126 to limit the current flowing through the output transistor 105.

The voltage developed across the resistor 133 when the overcurrent protection circuit 200 limits the current flowing through the output transistor 105 is constant regardless of the voltage of the output terminal 102. Here, in order to provide a simplified description, the PMOS transistors 123 and 124 and the NMOS transistors 131 and 132 are assumed to be equal in transistor size ratio. Since the current flowing through the resistor 133 is supplied by the current mirror circuits 202 and 203, the current flowing through the NMOS transistor 131 when the overcurrent protection circuit 200 limits the current flowing through the output transistor 105 is also constant. The current flowing through the NMOS transistor 131 is a current distributed from the current which flows from the drain of the PMOS transistor 122. This distribution is given as n+1:1 where the output terminal 102 is short-circuited to the ground terminal and the voltage of the output terminal 102 is high. Since the current flowing through the NMOS transistor 131 when the overcurrent protection circuit 200 limits the current flowing through the output transistor 105 is constant, the current which flows from the drain of the PMOS transistor 122 is given in the form of 1:n+1 where the output terminal 102 is short-circuited to the ground terminal and the voltage of the output terminal 102 is high. Since the PMOS transistor 122 provides the current proportional to the current flowing through the output transistor 105, the limited current flowing through the output transistor 105 is given in the form of 1:n+1 where the output terminal 102 is short-circuited to the ground terminal and the voltage of the output terminal 102 is high.

As described above, since the ratio between the limited and short-circuited currents is determined according to the size ratio between the components, i.e., the size ratio between the NMOS transistors 130 and 131, the overcurrent protection circuit 200 is capable of collectively performing adjustments of the values of the currents.

Figure 2:
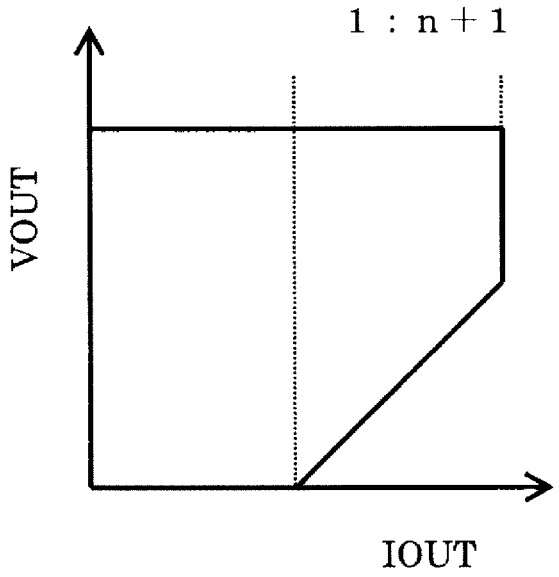
FIG. 2 is a graph illustrating an output current-voltage characteristic of the voltage regulator equipped with the overcurrent protection circuit, according to the first embodiment of the present invention.

FIG. 2 is a graph illustrating a relationship between an output current (load current) IOUT and an output voltage VOUT of the voltage regulator 100 according to the first embodiment. The load current IOUT made to flow by the output transistor 105 is reduced according to a reduction in the output voltage VOUT as the voltage of the output terminal 102. The ratio between the short-circuited current and the limited current which flow when the output terminal 102 is short-circuited to the ground terminal can be determined by 1:n+1 and the size ratio between the components.

Further, adjustments of the limited current and the short-circuited current to variations in a manufacturing process may be performed by trimming only the resistance value of the resistor 133 in the output current limitation circuit 204. Thus, the adjustable resistors have heretofore been required for the drooping type overcurrent protection circuit and the fold-back type overcurrent protection circuit respectively, i.e., the two adjustable resistors have been required, whereas according to the present embodiment, the adjustments of the limited and short-circuited currents to the variations in the manufacturing process are possible if one adjustable resistor is provided. It is therefore possible to suppress an increase in chip size.

[Second Embodiment]

Figure 3:
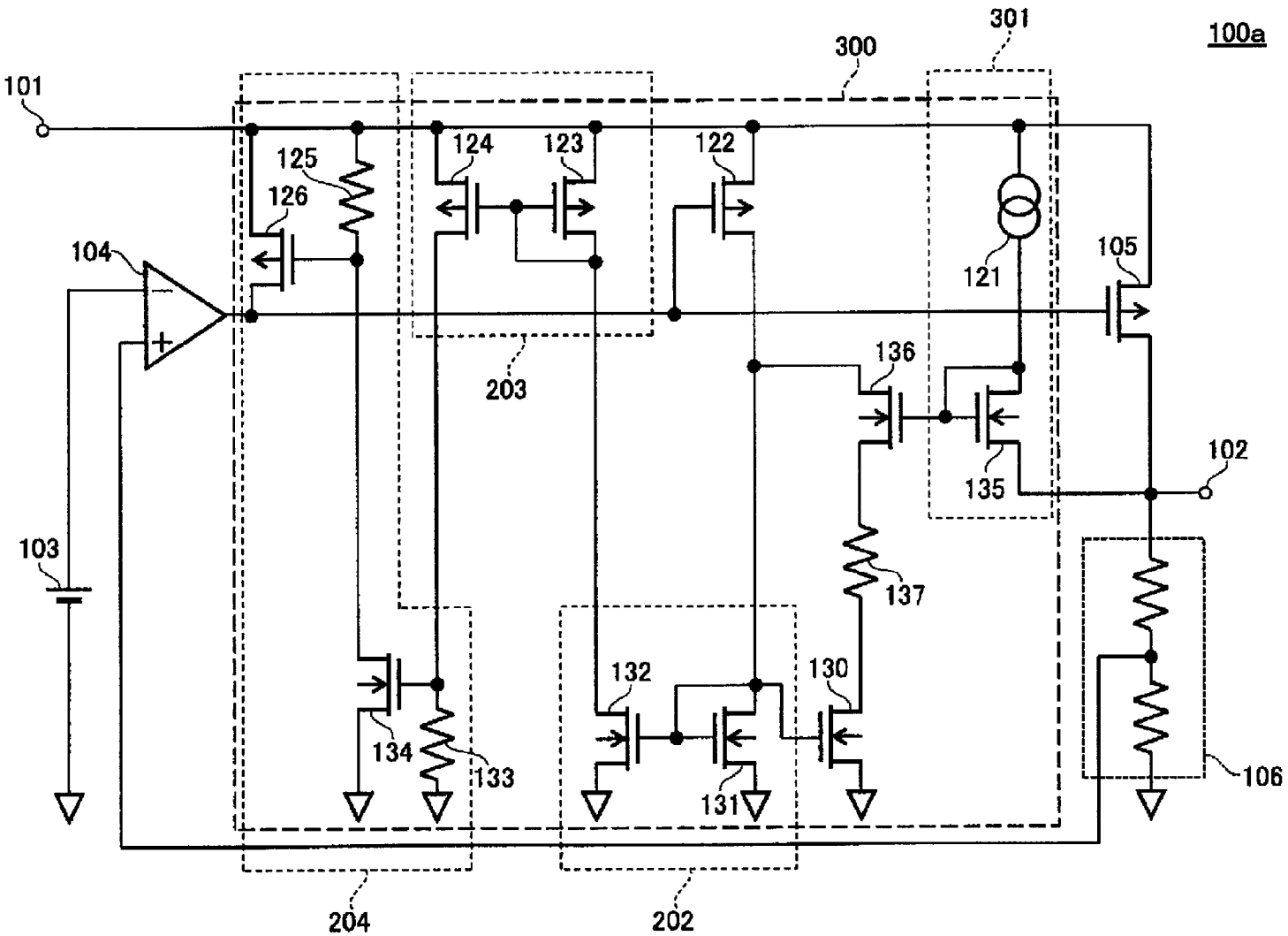
FIG. 3 is a circuit diagram of a voltage regulator equipped with an overcurrent protection circuit, according to a second embodiment of the present invention.

FIG. 3 is a circuit diagram of a voltage regulator 100*a* equipped with an overcurrent protection circuit 300, according to a second embodiment of the present invention.

The overcurrent protection circuit 300 in the second embodiment has a configuration in which the voltage control voltage source 201 comprised of the error amplifier 140 connected to the NMOS transistor 136 in the first embodiment is replaced with a voltage control voltage source 301 comprised of a current source 121 and an NMOS transistor 135. Since the overcurrent protection circuit 300 is similar in other configurations to the overcurrent protection circuit 200 illustrated in FIG. 1, the same reference numerals are respectively attached to the same components, and their dual description will be omitted as appropriate.

The current source 121 has one end connected to a power supply terminal 101 and the other end connected to a drain and a gate of the NMOS transistor 135. A source of the NMOS transistor 135 is connected to an output terminal 102. A gate of an NMOS transistor 136 is connected to the gate and drain of the NMOS transistor 135.

The operation of the overcurrent protection circuit 300 will next be described. A voltage divided by the current source 121 and the NMOS transistor 135 connected between the power supply terminal 101 and the output terminal 102 is applied to the gate of the NMOS transistor 136. Since the gate and drain of the NMOS transistor 135 are short-circuited, a voltage higher by a threshold voltage of the NMOS transistor 135 than the voltage of the output terminal 102 is applied to the gate of the NMOS transistor 136. Further, a voltage lower by a threshold voltage of the NMOS transistor 136 than the voltage applied to the gate of the NMOS transistor 136 is applied across a resistor 137 connected to a source of the NMOS transistor 136. Therefore, when the NMOS transistors 135 and 136 are elements of the same structure, the voltage equal to that of the output terminal 102 is applied across the resistor 137. Other operations are similar to those of the overcurrent protection circuit 200 in the first embodiment of the present invention.

[Third Embodiment]

Figure 4:
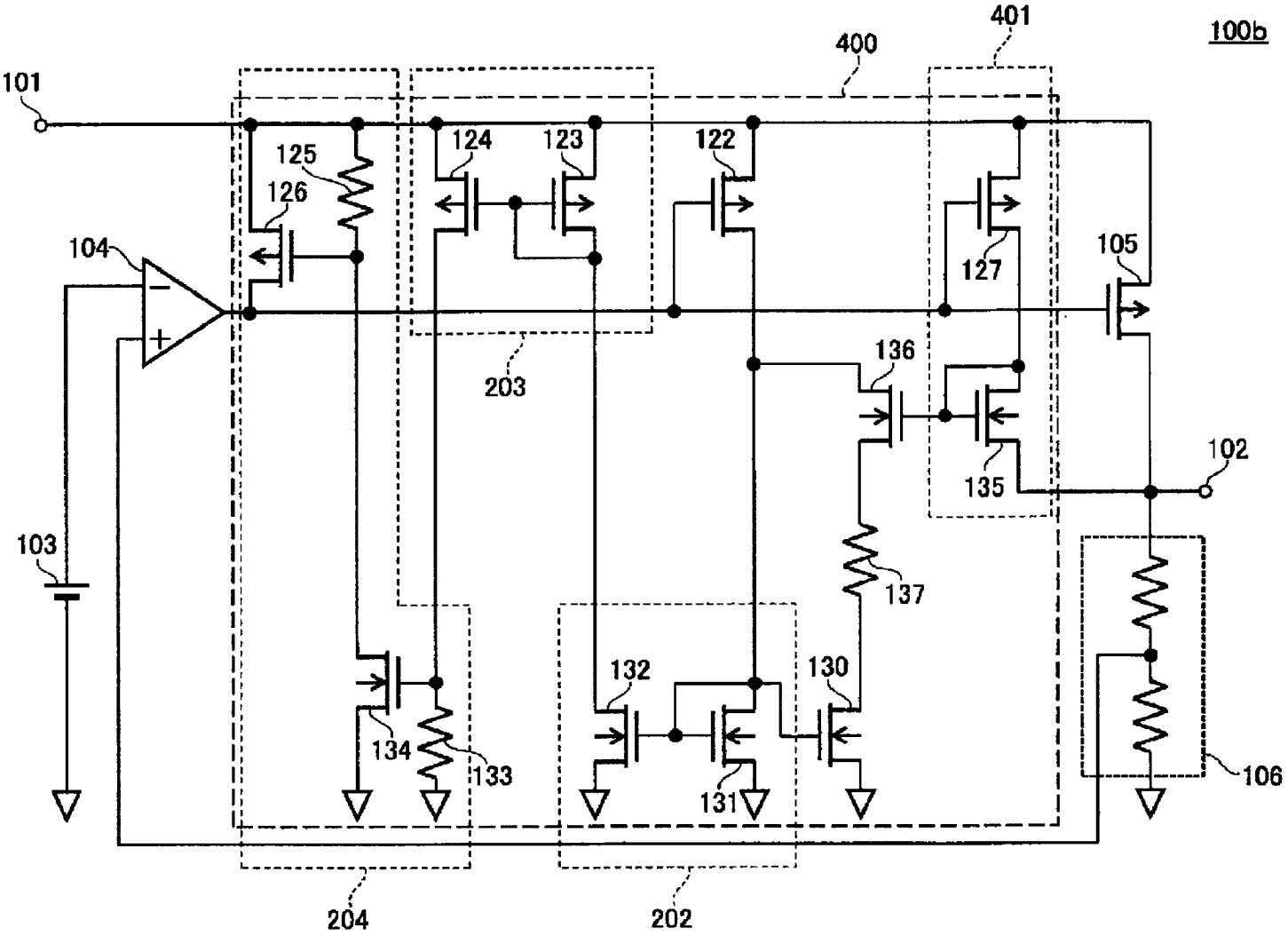
FIG. 4 is a circuit diagram of a voltage regulator equipped with an overcurrent protection circuit, acording to a third embodiment of the present invention.

FIG. 4 is a circuit diagram of a voltage regulator 100*b* equipped with an overcurrent protection circuit 400, according to a third embodiment of the present invention.

In the overcurrent protection circuit 400 of the third embodiment, the voltage control voltage source 301 comprised of the current source 121 and the NMOS transistor 135 in the second embodiment is configured by a voltage control voltage source 401 having a PMOS transistor 127 with which the current source 121 is replaced. Since other configurations are similar to those of the overcurrent protection circuit 100 illustrated in FIG. 1, the same reference numerals are respectively attached to the same components, and their dual description will be omitted as appropriate.

The PMOS transistor 127 has a gate connected to a gate of an output transistor 105, a source connected to a power supply terminal 101, and a drain connected to a gate and a drain of an NMOS transistor 135.

The operation of the overcurrent protection circuit 400 will next be described. Since the PMOS transistor 127 is made common to the output transistor 105 in terms of the gate and source, the PMOS transistor 127 allows a current proportional to a current supplied to a load by the output transistor 105 to flow from its drain. It is therefore possible to suppress a rise in the voltage of an output terminal 102 due to the current made to flow by the elements connected between the power supply terminal 101 and the output terminal 102 at the time of light load driving which makes it unnecessary for the output transistor 105 to supply the current to the load. Other operations are similar to those of the overcurrent protection circuits 200 and 300 in the first and second embodiments of the present invention.

A relationship between an output current (load current) IOUT and an output voltage VOUT in each of the voltage regulators according to the second and third embodiments becomes similar to the graph illustrated in FIG. 2.

Thus, the voltage regulators 100*a* and 100*b* according to the second and third embodiments can also obtain advantageous effects similar to the above-described advantageous effects obtained by the voltage regulator 100 according to the first embodiment.

What is claimed is:

1. A voltage regulator comprising:

an output transistor;

a first error amplifier circuit which amplifies and outputs a difference between a divided voltage obtained by dividing a voltage outputted from the output transistor and a reference voltage and thereby controls a gate of the output transistor; and an overcurrent protection circuit which detects that an overcurrent flows through the output transistor, to thereby limit the overcurrent of the output transistor, wherein the overcurrent protection circuit includes:

a first transistor which is controlled by an output voltage of the first error amplifier circuit and senses an output current of the output transistor, a second transistor having a source grounded, and a gate and a drain connected to a drain of the first transistor, a third transistor having a drain connected to the drain of the first transistor, a first resistor connected to a source of the third transistor, a fourth transistor having a source grounded, a gate connected to the gate and drain of the second transistor, and a drain connected to the source of the third transistor through the first resistor, a fifth transistor having a source grounded, and a gate connected to the gate and drain of the second transistor, a voltage control voltage source which controls a gate of the third transistor in such a manner that the voltage outputted from the output transistor and a voltage applied across the first resistor become equal to each other, a current mirror circuit which outputs a current proportional to a current flowing through the fifth transistor, and an output current limitation circuit which controls a gate voltage of the output transistor by the current outputted from the current mirror circuit.

2. The voltage regulator according to claim 1, wherein the voltage control voltage source further comprises a second error amplifier circuit which amplifies and outputs a difference between the voltage outputted from the output transistor and the voltage applied across the first resistor and thereby controls the gate of the third transistor.

3. The voltage regulator according to claim 1, wherein the voltage control voltage source further comprises:

a sixth transistor having a source connected to the output of the output transistor, and a gate and a drain connected to the gate of the third transistor, and a first current source which supplies a constant current to the gate and drain of the sixth transistor.

4. The voltage regulator according to claim 3, wherein the first current source further comprises a seventh transistor which is controlled by the output voltage of the first error amplifier circuit and senses the output current of the output transistor.

5. The voltage regulator according to claim 1, wherein the current mirror circuit further comprises:

an eighth transistor having a source connected to a power supply terminal, and a gate and a drain connected to a drain of the fifth transistor, and a ninth transistor which has a source connected to the power supply terminal, and a gate connected to the gate and drain of the eighth transistor, and outputs a current from a drain of the ninth transistor.

6. The voltage regulator according to claim 1, wherein the output current limitation circuit further comprises:

a second resistor which converts the output current of the current mirror circuit into a voltage, a tenth transistor having a source grounded, and a gate inputted with a voltage developed across the second resistor, a third resistor which converts a current outputted from a drain of the tenth transistor into a voltage, and an eleventh transistor having a source connected to the power supply terminal, a gate inputted with a voltage developed across the third resistor, and a drain connected to the gate of the output transistor.

* * * * *